US006082494A

United States Patent [19]

Massicotte

[11] Patent Number: 6,082,494

[45] Date of Patent: Jul. 4, 2000

[54] FLUID DEFLECTING AND STRAINING SYSTEM

[75] Inventor: Michel Massicotte, Boucherville, Canada

[73] Assignee: Pratt & Whitney Canada Inc., Longueuil, Canada

[21] Appl. No.: 09/090,210

[22] Filed: Jun. 4, 1998

[51] Int. Cl.[7] ..... F16H 7/36; F16H 11/12

[52] U.S. Cl. ..... 184/43; 184/6.11; 277/423

[58] Field of Search ..... 184/6.11, 43, 38, 184/70; 277/423

[56] References Cited

U.S. PATENT DOCUMENTS

| | | | |
|---|---|---|---|
| 1,886,618 | 11/1932 | Anstice | 277/423 |
| 1,945,219 | 1/1934 | Fruhstorfer | 286/5 |
| 3,285,004 | 11/1966 | Hopley | 60/39.08 |
| 4,095,857 | 6/1978 | Palmer | 184/6.11 |
| 4,333,659 | 6/1982 | Gibbs . | |
| 4,629,564 | 12/1986 | Pinato | 210/512.3 |
| 5,066,192 | 11/1991 | Honda et al. . | |

FOREIGN PATENT DOCUMENTS 966352 8/1964 United Kingdom .

*Primary Examiner*—David M. Fenstermacher
*Attorney, Agent, or Firm*—Jeffrey W. Astle

[57] ABSTRACT

A device for deflecting a fluid flow comprises a casing having a circumferential wall defining a fluid passage, a rotating member disposed in the fluid passage for rotation about an axis substantially parallel to a flow of fluid within the fluid passage, a deflector extending radially from the rotating member for rotation therewith, and an outlet opening defined in the circumferential wall. The revolution of the deflector within the fluid passage forces the fluid to pass through the outlet opening where it can be collected by a strainer.

11 Claims, 2 Drawing Sheets

FLUID DEFLECTING AND STRAINING SYSTEM

BACKGROUND OF THE INVENTION

1. Field of the Invention

The present invention relates to deflectors and, more particularly, pertains to a device for diverting the flow of a fluid into a fluid outlet opening where it can be collected by a strainer.

2. Description of the Prior Art

Over the years various deflectors have been developed in order to divert the flow of a fluid in a channel. Although such conventional fluid deflectors are effective, it has been found that there is a need for a new deflecting system which is adapted to force a fluid flow into a strainer by means of centrifugal force to thus prevent potential debris from flowing between a rotating member and a static member.

SUMMARY OF THE INVENTION

It is therefore an aim of the present invention to provide a device which is adapted to deflect a fluid flow.

It is also an aim of the present invention to provide a device which is adapted to divert a fluid flow into a strainer.

It is a further aim of the present invention to provide a device which is adapted to prevent coarse particles from flowing between rotating and static members.

It is still an aim of the present invention to provide a deflector which is relatively simple and economical to manufacture.

Therefore, in accordance with the present invention, there is provided a device for deflecting a fluid flow comprising a casing having internal wall means defining a fluid passage, a rotating member disposed in the fluid passage for rotation about an axis substantially parallel to a flow of fluid within the fluid passage, a deflector extending radially from the rotating member for rotation therewith, and an outlet opening defined in the internal wall means, whereby revolution of the deflector within the fluid passage causes at least part of the fluid to pass through the outlet opening.

Also in accordance with the present invention there is provided a device for straining a fluid flowing around a rotating member axially disposed in a substantially elongated fluid passage delimited by a peripheral surface, comprising a fluid deflector coaxially disposed around the rotating member for rotation therewith, an outlet opening defined in the peripheral surface, the outlet opening leading to a strainer, whereby revolution of the fluid deflector within the fluid passage causes at least part of the fluid to pass through the outlet opening where the fluid can be collected by the strainer.

In a further construction in accordance with the present invention, the driving shaft is provided with a shear section at a location between a source of power coupled to the driving shaft and the fluid deflector.

In a still further construction in accordance with the present invention, the strainer includes a filtering surface defining a plurality of openings and a clearance space is defined between the fluid deflector and the peripheral surface. The clearance space is smaller than the openings of the filtering surface of the strainer.

BRIEF DESCRIPTION OF THE DRAWINGS

Having thus generally described the nature of the present invention, reference will now be made to the accompanying drawings, showing by way of illustration a preferred embodiment thereof, and in which.

DESCRIPTION OF THE PREFERRED EMBODIMENTS

Figure 1:
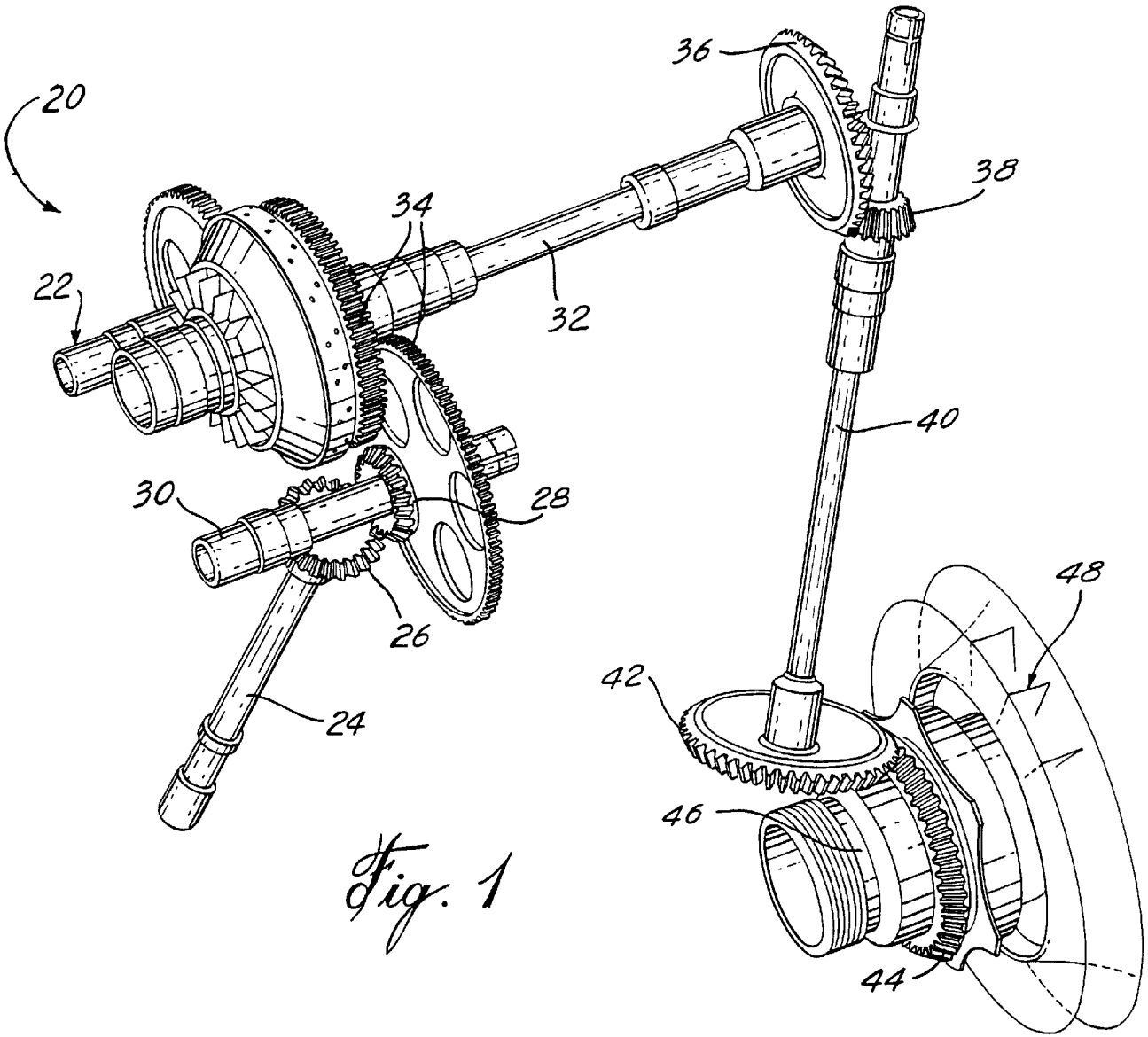
FIG. 1 is a schematic perspective view of an accessory drive train of a gas turbine engine.

Now referring to the drawings, and in particular to FIG. 2, a fluid deflecting system in accordance with the present invention and generally designated by numeral 10 will be described.

According to an application of the present invention, the fluid deflecting system 10 may be used in connection with a lubricating oil pump arrangement 12 of a gas turbine engine (not shown) to urge a flow of oil to pass through a static strainer 14 disposed upstream of two parallel series of vane-type pumps 16 and 18 supplying oil under pressure to gears and bearings of the gas turbine engine, as will be explained hereinafter.

As seen in FIG. 1, the gas turbine engine (not shown) includes an accessory drive train 20 which consists of a series of shafts connected to one another by gears for transmitting power to various parts of the engine, such as the lubricating oil pump arrangement 12 and the starter unit 22. More particularly, the lubricating oil pump arrangement 12 includes an oil pump driving shaft 24 having a bevel gear 26 meshed with a corresponding bevel gear 28 mounted on a fuel pump driving shaft 30. The driving shaft 30 is connected to an air breather driving shaft 32 by means of a pair of spur gears 34. The air breather driving shaft 32 is provided at an opposed end thereof with a bevel gear 36 which is meshed with another bevel gear 38 mounted at a first end of an intermediate driving shaft 40. A second bevel gear 42 is also mounted to the intermediate driving shaft 40 and engages a cooperating bevel gear 44 secured to a drive shaft 46 which also mount the high pressure compressor rotor 48 of the turbine engine. Accordingly, the power needed to operate the lubricating oil pump arrangement 12 is transmitted to the oil pump driving shaft 24 by the high pressure compressor drive shaft 46.

Figure 2:
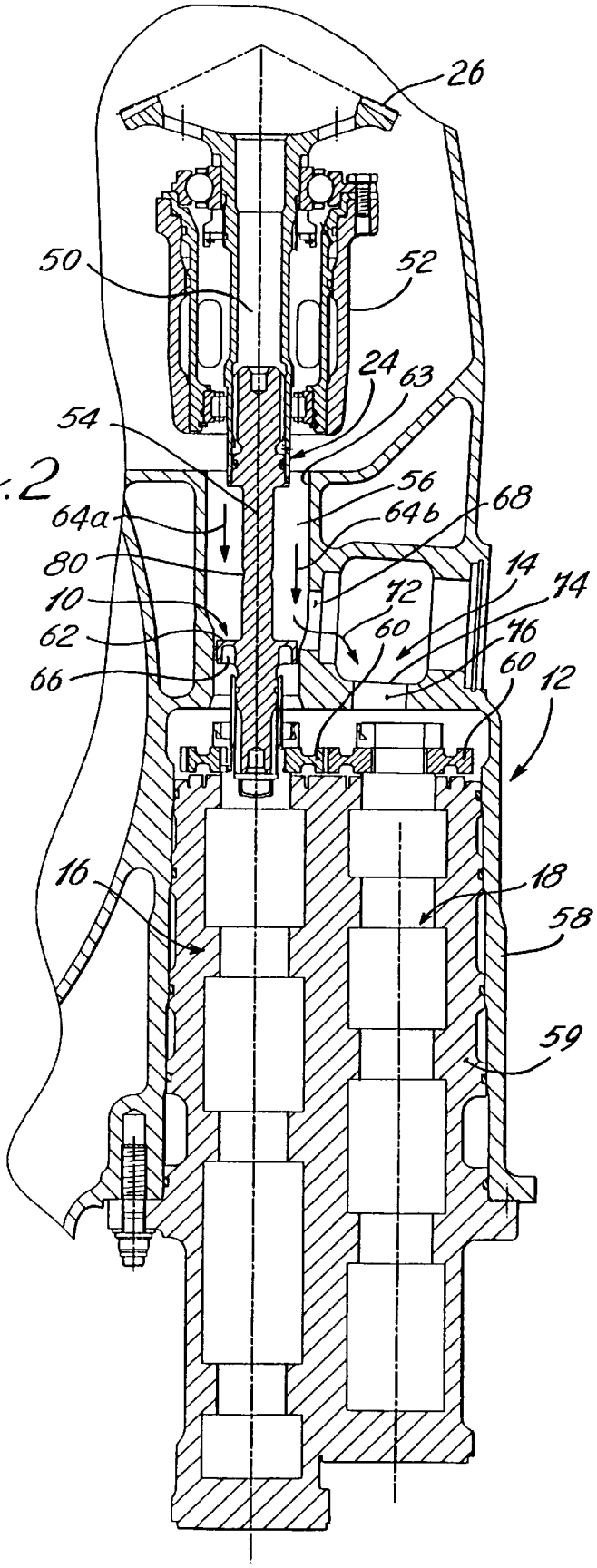
FIG. 2 is a cross-sectional view of a lubricating oil pump arrangement of the gas turbine engine in accordance with the present invention.

Referring to FIG. 2, it can be seen that the oil pump driving shaft 24 includes a first portion 50 extending through a bearing housing 52. A second portion 54 having a smaller cross-sectional dimension is partly inserted into a hollow end portion of the first portion 50 of the oil pump driving shaft and extends through a substantially cylindrical fluid passage 56 defined in the casing 58 which encloses a pump housing 59. The first and second series of vane-type pumps 16 and 18 are located in the pump housing 59. It is noted that the oil pump driving shaft 24 may include a flexible coupling to compensate for misalignments thereof.

The first series of vane-type pumps 16 is directly coupled to the oil pump driving shaft 24, whereas the second series of vane-type pumps 18 is connected thereto by a pair of spur gears 60. As schematically illustrated in FIG. 2, the first and second series of vane-type pumps 16 and 18 are each composed of a number of pumps mounted end to end on a common shaft. It is noted that the pumps of a same series may have different sizes and capacities. For instance, certain pumps may be used for pumping at low pressure and other pumps may be used for delivering at high pressure.

A deflector such as a flat circular disc 62 extends from the circumference of the second portion 54 of the oil pump driving shaft 24. In the present embodiment, the disc 62 is integral to the oil pump driving shaft 24 and is provided with an axial cylindrical skirt defining an annular hollow portion 66 to minimize the weight thereof. A small clearance is provided between the disc 62 and skirt, and the internal circumferentially extending wall 63 of the casing 58. The circumferentially extending wall 63 defines the fluid passage 56 in which the disc 62 deflects a portion of the oil drawn therethrough by the first and second series of pumps 16 and 18, as indicated by arrows 64*a* and 64*b*.

In operation, the oil pump driving shaft 24 is rotated at a speed of about 5000 RPM to transmit power to both parallel series of pumps 16 and 18 which in turn draw the oil through the fluid passage 56 where it encounters revolving disc 62. As the oil contacts the upper surface of the disc 62, it is forced outwardly, by centrifugal force, of the fluid passage 56 through an outlet opening 68 defined in the internal circumferentially extending wall 63 of the casing 58, as indicated by arrow 72.

The oil passing through the outlet opening 68 will pass through the static strainer 14 which is adapted to remove solid particles from the oil before it enters the pumps. The static strainer 14 is provided with a perforated metal cylinder or a fine wire-mesh screen 74 defining a plurality of small aligned openings (not shown) which according to a preferred embodiment of the present invention have a respective diameter of about 0.075 inch. The filtered oil will then flow through a passage 76 which leads from the screen 74 to the first and second series of pumps 16 and 18. It is noted that in this particular case, the clearance space between the disc 62 and the internal wall 63 of the casing 58 is in a range of about 0.02 to 0.06 inch to provide some oil flow between the disk 62 and the internal wall 63 but without allowing passage of solid particles which are deflected to and collected by the strainer 14.

Preferably, disc 62 is enclosed by the portion of internal wall 63 which includes outlet opening 68, with the skirt of disc 62 extending within fluid passage 56 past outlet opening 68 as illustrated in FIG. 2, to avoid the accumulation of debris that could result from the disc 62 and the skirt being enclosed entirely by a portion of internal wall 63 below outlet opening 68.

An advantage of the above described fluid deflecting system 10 resides in the fact that it enables the redirection and screening of debris which cannot pass between the rotating and static members without requiring a seal between the rotating member and the static member.

As seen in FIG. 2, the second portion 54 of the oil pump driving shaft 24 is provided with a shear section 80 which is more susceptible to break than the remaining part of the oil pump driving shaft 24. The shear section 80 is defined on the oil pump driving shaft 24 between the bevel gear 26 and the disc 62 to thus ensure that in the event that the oil pump driving shaft 24 is broken apart, the disc will automatically be separated from the portion of the shaft which will still be driven by the drive shaft 46, thereby preventing the disc 62 from damaging the internal wall 63.

What is claimed is:

1. A device for deflecting a fluid flow comprising a casing having internal wall means defining a fluid passage, a rotating member disposed in said fluid passage for rotation about an axis substantially parallel to a flow of fluid within said fluid passage, a deflector extending radially from said rotating member for rotation therewith, said deflector having a radially outermost surface extending in close proximity in a radial direction to said internal wall means to prevent coarse particles from flowing downstream of said deflector while allowing at least some of the fluid to flow over said deflector to a downstream side thereof, and an outlet opening defined in said internal wall means, whereby revolution of said deflector within said fluid passage causes at least part of said fluid to pass through said outlet opening.

2. A device as defined in claim 1, wherein said outlet opening leads to a strainer adapted to filter the fluid passing therethrough.

3. A device as defined in claim 2, wherein said strainer includes a filtering surface defining a plurality of openings, and wherein a clearance space is defined between said radially outermost surface of said deflector and said internal wall means, said clearance space being smaller than said openings of said filtering surface of said strainer.

4. A device as defined in claim 1, wherein said deflector is integral to said rotating member.

5. A device as defined in claim 1, wherein said deflector includes a flat disc concentrically disposed with respect to said rotating member, and wherein said internal wall means have a cylindrical configuration.

6. A device as defined in claim 1, wherein said deflector extends axially in said fluid passage from a position downstream of said outlet opening to at least a radial plane intersecting said outlet opening.

7. A device for straining a fluid flowing around a rotating member axially disposed in a substantially elongated fluid passage delimited by a peripheral surface, comprising a fluid deflector coaxially disposed around said rotating member for rotation therewith, said fluid deflector having a radially outermost surface extending in close proximity in a radial direction to said peripheral surface to prevent potential coarse particles from flowing downstream of said fluid deflector while allowing at least some of the fluid to flow over said deflector to a downstream side thereof, an outlet opening defined in said peripheral surface, said outlet opening leading to a strainer, whereby revolution of said fluid deflector within said fluid passage causes at least part of said fluid to pass through said outlet opening where said fluid can be collected by said strainer.

8. A device as defined in claim 7, wherein said fluid deflector extends axially in said fluid passage from a position downstream of said outlet opening to at least a radial plane intersecting said outlet opening.

9. A device as defined in claim 7, wherein said strainer includes a filtering surface defining a plurality of openings, and wherein a clearance space is defined between said fluid deflector and said peripheral surface, said clearance space being smaller than said openings of said filtering surface of said strainer.

10. A device as defined in claim 7, wherein said rotating member is a driving shaft of a rotating pump.

11. A device as defined in claim 10, wherein said driving shaft is provided with a shear section at a location between a source of power of said rotating pump and said fluid deflector.

* * * * *